US006773384B2

(12) United States Patent
Guiot et al.

(10) Patent No.: US 6,773,384 B2
(45) Date of Patent: Aug. 10, 2004

(54) SHEET PROCESSING MACHINE FOR MAKING PACKAGES

(75) Inventors: Bernard Guiot, Feneu (FR); Philippe Vallee, Saint Martin du Foullioux (FR)

(73) Assignee: Rapidex S.M., Angers (FR)

( * ) Notice: Subject to any disclaimer, the term of this patent is extended or adjusted under 35 U.S.C. 154(b) by 0 days.

(21) Appl. No.: 10/312,138

(22) PCT Filed: Jul. 5, 2001

(86) PCT No.: PCT/FR01/02155

§ 371 (c)(1),
(2), (4) Date: Dec. 23, 2002

(87) PCT Pub. No.: WO02/02305

PCT Pub. Date: Jan. 10, 2002

(65) Prior Publication Data

US 2003/0191001 A1 Oct. 9, 2003

(30) Foreign Application Priority Data

Jul. 6, 2000 (FR) ..... 00 08785

(51) Int. Cl.[7] ..... B31B 1/02

(52) U.S. Cl. ..... 493/71; 493/8; 493/10; 493/21; 493/34; 493/71; 493/81; 493/180; 53/52; 53/58

(58) Field of Search ..... 493/3, 8, 10, 21, 493/22, 23, 34, 71, 72, 81, 180; 53/52, 55, 58

(56) References Cited

U.S. PATENT DOCUMENTS 4,604,083 A * 8/1986 Barny et al. ..... 493/34
4,715,847 A * 12/1987 Focke et al. ..... 493/11
5,123,887 A * 6/1992 Shimura ..... 493/34
5,152,734 A * 10/1992 McAdam et al. ..... 493/10
5,301,270 A * 4/1994 Steinberg et al. ..... 345/866
5,350,348 A 9/1994 Guot
5,624,369 A * 4/1997 Bidlack et al. ..... 493/355
6,059,705 A 5/2000 Ruthenberg et al.
6,234,943 B1 * 5/2001 Copin ..... 493/11
6,475,128 B1 * 11/2002 Wallace et al. ..... 493/8

FOREIGN PATENT DOCUMENTS

| | | |
|---|---|---|
| EP | 0 539 254 | 4/1993 |
| EP | 0 669 208 | 8/1995 |
| GB | 2 205 270 | 12/1988 |
| GB | 2 302 834 | 2/1997 |
| WO | WO 97/15439 | 5/1997 |

* cited by examiner

*Primary Examiner*—Stephen F. Gerrity
*Assistant Examiner*—Hemant M. Desai
(74) *Attorney, Agent, or Firm*—Nath & Associates PLLC; Gary M. Nath; Derek Richmond

(57) ABSTRACT

A machine for treating sheets, said machine comprising drive means (14, 16, 18) for driving the sheets, treatment tooling (52, 62) for forming cutouts or folds in said sheets that extend transversely to the drive direction (F) in which the sheets are driven. The treatment tooling is carried by at least one carrier shaft (52, 62) driven by a shaft motor (M52, M62). The sheets are driven at a substantially constant drive speed through the machine, and said machine further comprises a control unit (UC) which, as a function of said drive speed, and of information relating to the position of a sheet in the machine, control the shaft motor (M52, M62) such that, for treating said sheet, the tooling is in contact with a predetermined region of the sheet and is driven at a treatment speed whose tangential component is equal to the drive speed at which the sheet is driven.

17 Claims, 8 Drawing Sheets

FIG.10
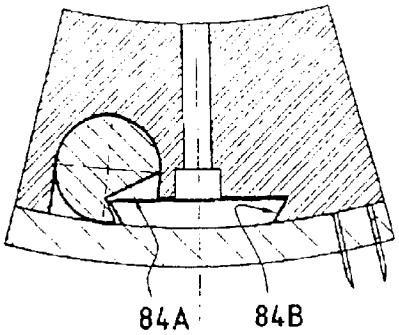
FIG.9
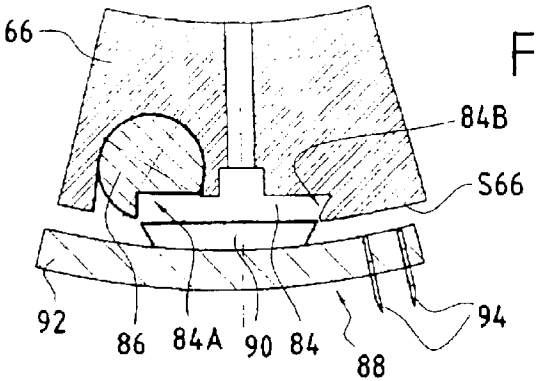
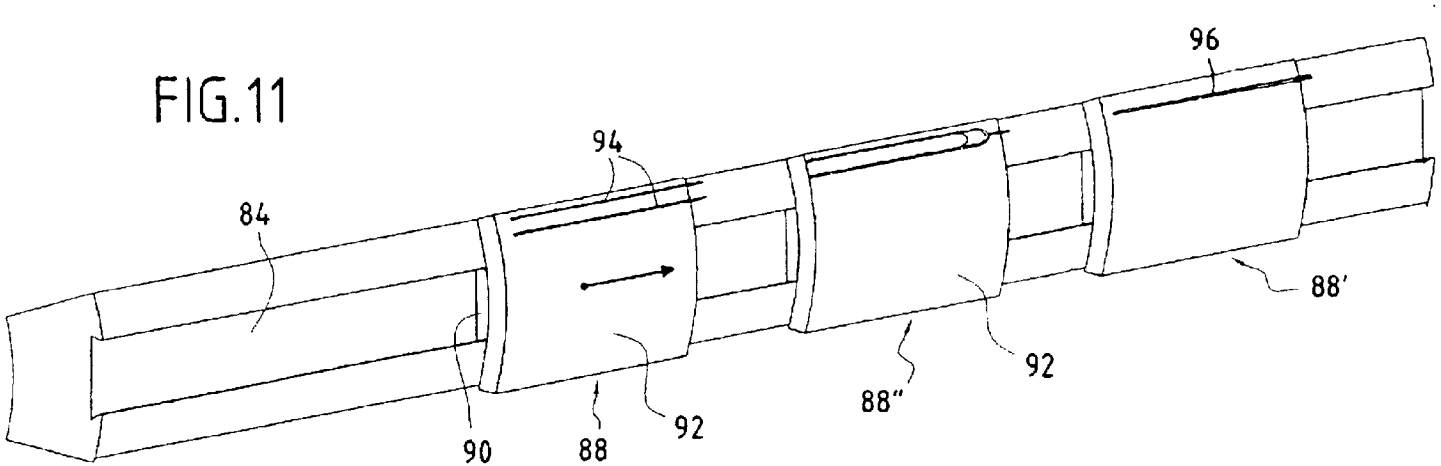
FIG.11

SHEET PROCESSING MACHINE FOR MAKING PACKAGES

BACKGROUND OF THE INVENTION

The present invention relates to a machine for treating sheets, in particular for manufacturing packaging made of materials such as cardboard or plastic, said machine comprising drive means having at least one drive motor and suitable for driving sheets in a drive direction through a treatment zone situated between the inlet and the outlet of the machine, treatment tooling designed to form cutouts and/or folds that are disposed transversely relative to the drive direction in said sheets, means for determining information relating to the position of a sheet in the treatment zone, and control means for controlling the treatment tooling as a function of said information.

For manufacturing packaging from sheets of cardboard or of plastic, firstly "transverse" machines of the above-mentioned type are known in which at least the majority of the cutouts or folds are provided transversely relative to the advance direction in which the sheets advance through the machine. Secondly, "longitudinal" machines are known, e.g. of the type described in the Applicant's Patent Application EP 0 539 254, in which the majority of the folds and of the cutouts are provided in the advance direction in which the sheets advance through the machine.

Longitudinal machines reach high manufacturing throughputs. The various manufacturing steps are performed by cylinders turning at high speeds. The developed length of each cylinder determines the length of the sheets that it is possible to treat in the machine. As a result, with any given longitudinal machine, it is possible to manufacture only items of packaging whose length varies within a narrow range determined by the minimum and maximum developed lengths of the machine.

In transverse machines of known type, the various tools (cutting tools, scoring tools) are carried by beams which are disposed transversely relative to the advance direction in which the sheets advance, and which can be moved vertically between working positions and retracted positions. Various tools can be mounted on the beams, which makes it possible to manufacture a variety of items of packaging. However, the sheet treatment operations performed by the cutting or scoring tools can be performed only while the sheets are stationary. Thus, the drive means advance the sheets stepwise between each treatment step. As a result, the manufacturing throughputs of known transverse machines are very low since, for example, they reach only 300 boxes per hour.

SUMMARY OF THE INVENTION

The invention proposes to improve transverse machines of the type mentioned in the introduction so as to enable them to reach manufacturing throughputs that are significantly higher, e.g. of the order of 1000 boxes per hour.

This object is achieved by means of the facts that the treatment tooling is carried by at least one transverse carrier shaft rotated by a shaft motor which is distinct from said at least one drive motor, that the drive means are suitable for driving the sheets at a substantially constant drive speed between the inlet and the outlet of the machine, and that said machine further comprises a control unit suitable for acting as a function of said advance speed and of the information relating to the position of a sheet in the treatment zone, to control the shaft motor such that, for treating said sheet, the tooling is in contact with a predetermined region of the sheet and is driven at a treatment speed whose tangential component is equal to said drive speed.

Unlike the prior art for transverse machines, which drive the sheets through the machine stepwise, the invention thus proposes to drive the sheets at substantially constant speed, without any stop stage. The tooling serving to form the transverse folds or cutouts is carried by the carrier shaft which is disposed transversely relative to the drive direction in which the sheets are driven, and which is driven by a shaft motor that is specific to it. Since it knows the drive speed at which the sheets are driven, the position of the tooling on the transverse carrier shaft, the position of a sheet in the treatment zone, and the positions of the cutouts or folds that are to be formed in said sheet, the control unit of the machine controls the shaft motor of the carrier shaft, rather than the sheet drive means, so that, during sheet treatment, the tooling is accurately in contact with that region of the sheet in which a fold or cutout is to be formed, and is driven at a treatment speed equal to the drive speed.

In other words, instead of servo-controlling the drive of the sheets on predetermined positions of the treatment tools, the invention makes provision to use an electronic control unit to servo-control the positions and the speeds of the treatment tools on the sheet and on the speed at which said sheet is driven.

The shaft motor must be sufficiently reactive and flexible for its speed to increase and decrease within a very short lapse of time so as to be controlled to operate at a precise value which is the drive speed at which the sheets are driven. For example, a positioning motor such as a motor having a multi-pole shaft that delivers torque that is substantially constant both at low speed and at high speed can be suitable. It is also possible to choose an electric motor of the asynchronous type or a brush-less motor.

In known transverse machines, it is possible to fit various tools to the same beam by aligning them transversely. In which case, cutouts or folds to be formed in two regions of the sheet that are spaced apart in the advance direction in which the sheet advances must be formed either by the same beam during two successive stops of the sheet passing under said beam, or by two spaced-apart beams.

Also to achieve the object of increasing manufacturing throughputs, the invention advantageously makes it possible, to perform two treatments (cutting or folding) on the sheet in two zones spaced apart from each other in the drive direction in which said sheet is driven, and to do so using the same carrier shaft.

Thus, advantageously, the machine has a carrier shaft with angular tool adjustment comprising a hub, a fixed tool holder secured to the hub, and a moving tool holder secured to a moving support which co-operates with the hub via position adjustment means making it possible to adjust the angular position of the moving tool holder relative to the fixed tool holder.

In which case, it is possible not only to treat two spaced-apart zones of the sheet by means of tools carried by respective ones of the two tool holders, but also to adapt the machine rapidly to accommodate different types of packaging, for which the spacing between said zones is different, by moving the moving tool holder relative to the fixed tool holder.

In which case, advantageously, the fixed tool holder is fixed to the hub by being disposed on a first cylinder generator line, the moving support comprises at least one band to which the moving tool holder is fixed along a second cylinder generator line, said band being coaxial with the hub, having an inner set of teeth and extending, in the region of the first generator line in a space provided between the outside surface of the fixed tool holder and the hub, and the position adjustment means comprise a cog shaft which is disposed between the hub and the band while co-operating with the inner set of teeth of said band, and means for driving the cog shaft in rotation, so as to cause the band to turn relative to the hub and thus to adjust the angular positioning of the second generator line relative to the first generator line.

This simple and reliable configuration makes it very fast to modify the angular spacing between the moving tool holder and the fixed tool holder, to adapt the machine to manufacturing different items of packaging.

Advantageously, the carrier shaft has at least one tool holder equipped with fast fixing means for a tool, which means comprise a longitudinal fixing groove situated on the outside surface of the tool holder, at least one of the longitudinal edges of said groove being a moving edge and being defined by a wedging piece that is mounted to move between a locking position, in which it co-operates with the opposite edge to define a retaining profile suitable for retaining a fixing rib having a complementary profile, and an unlocking position, in which the edge is spaced apart from the opposite edge to enable the fixing rib to be inserted into said groove, by moving the rib radially towards the axis of the carrier shaft.

To achieve the general object of avoiding any unnecessary loss of time while the machine is being used, the invention thus makes it possible to simplify fitting the tools to the carrier shaft by using the fast fixing means.

Advantageously, the machine has a multiple tool carrier shaft suitable for carrying at least first and second tools spaced angularly apart, and the control unit is suitable for controlling the shaft motor of said multiple tool carrier shaft in compliance with a cycle comprising a first tool treatment stage during which the first tool is in contact with a first determined region of a sheet situated in the treatment zone of the machine and is driven at a tangential velocity equal to drive speed at which said sheet is driven, a positioning phase during which the multiple tool carrier shaft is driven to position the second tool in a situation in which it can treat a second determined region of the sheet, and a second tool treatment stage, during which the second tool is in contact with said second region and is driven at a tangential velocity equal to the drive speed.

With the carrier shaft with angular tool adjustment, having a fixed tool holder and a moving tool holder, it is possible to adjust the position of the moving tool holder so that said carrier shaft turns at the same speed (which, converted to tangential velocity is equal to the drive speed at which the sheets are driven through the machine) during the first tool treatment stage, during the positioning stage, and during the second tool treatment stage. In which case, the angular spacing between the two tools corresponds to the distance between the two treatment zones in which the two tools must respectively act. In certain cases, even with the carrier shaft with angular tool adjustment, the positioning stage can nevertheless be performed at a speed somewhat different from the drive speed at which the sheets are driven.

However, the multiple tool carrier shaft may also carry different tools in determined zones and may be driven during the positioning stage at a speed that is higher or lower than the drive speed at which the sheets are driven so as to put the second tool in the proper position for the second tool treatment stage.

Advantageously, the machine has means for moving the multiple tool carrier shaft away from the advance path along which the sheets advance through the treatment zone during the positioning stage.

For example, the multiple tool carrier shaft may carry three or four tools spaced apart angularly, an intermediate tool being interposed between the first and second above-mentioned tools, e.g. to be used optionally. In which case, the multiple tool carrier shaft is driven at a speed corresponding to the drive speed at which the sheets are driven for the first tool treatment stage, is then moved away from the advance path along which the sheets advance, and, while in this situation, can be moved rapidly to position the second tool in a situation for treating the second determined region of the sheet, without the intermediate tool coming into contact therewith.

In an advantageous variant, the drive means co-operate with adjustable-position drive wheels which are mounted on wheel supports, and the machine has means for adjusting the positions of said supports transversely relative to the drive direction in which the sheets are driven through the machine.

It is desirable to dispose the drive wheels in positions determined by the width of the sheet, as measured in the transverse direction. For example, the adjustable-position drive wheels must support particular zones of the sheet or form certain cutouts or certain folds which must be disposed parallel to the drive direction in which the sheets are driven.

In which case, the machine has at least one adjustment belt disposed transversely relative to the drive direction in which the sheets are driven, means for driving said belt, and coupling means suitable for being caused to go between a coupling situation in which they secure a wheel support to said belt, and a stop position in which they secure said wheel support to a fixed locking part.

Thus, the wheel supports and therefore the wheels that they carry are easy to move relative to one another without it being necessary to remove them.

BRIEF DESCRIPTION OF THE PATENT DRAWINGS

The invention will be well understood, and its advantages will appear more clearly on reading the following detailed description of an embodiment shown by way of non-limiting example. The description refers to the accompanying drawings, in which.

Figure 5:
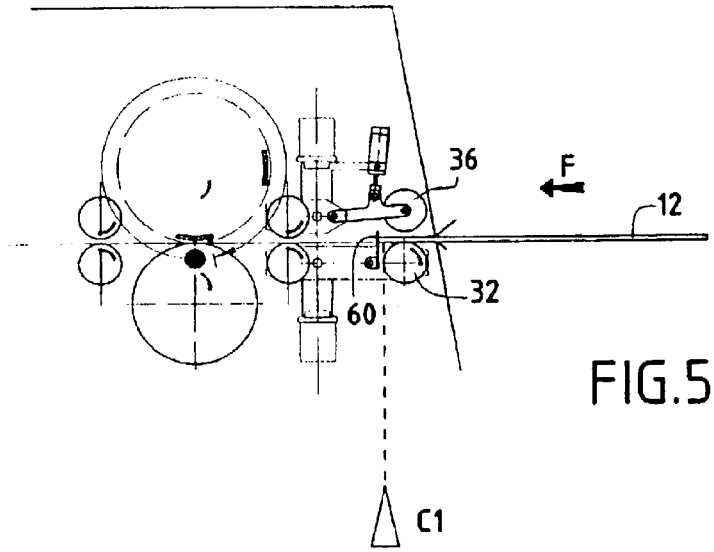
Figure 6:
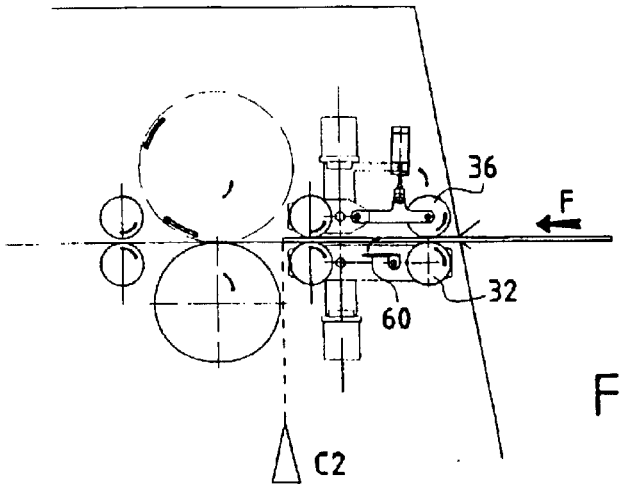
Figure 3:
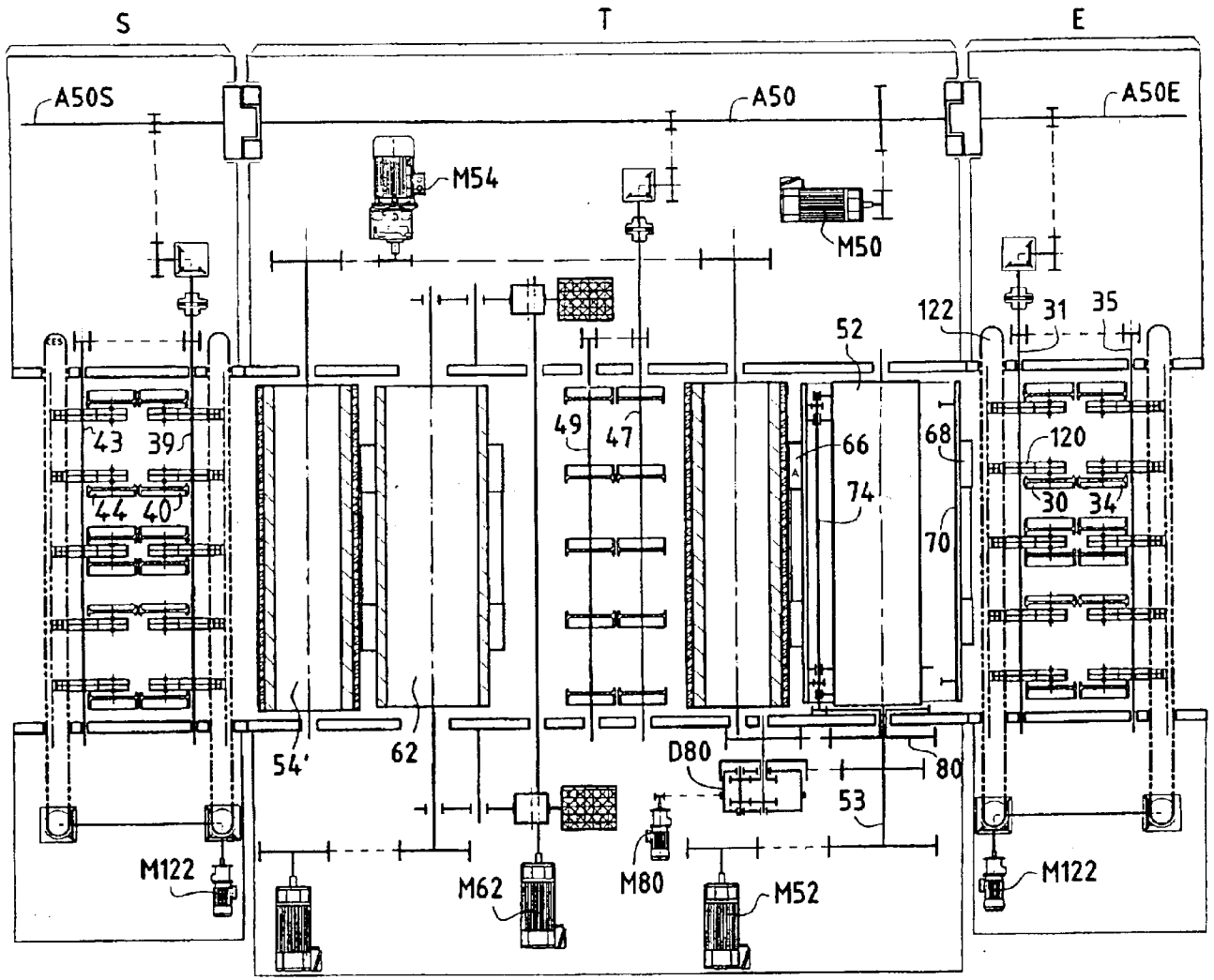
Figure 4:
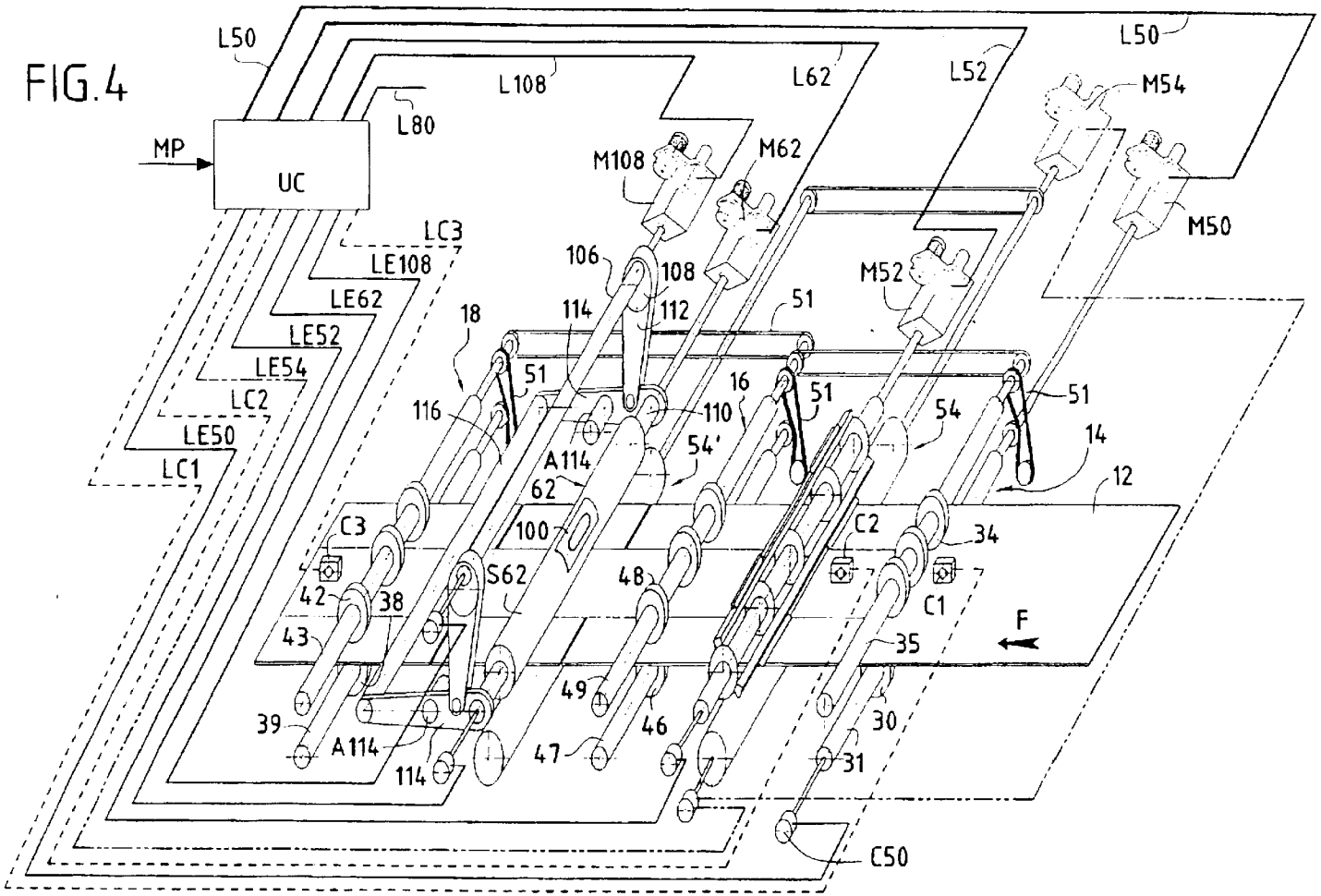
Figure 7:
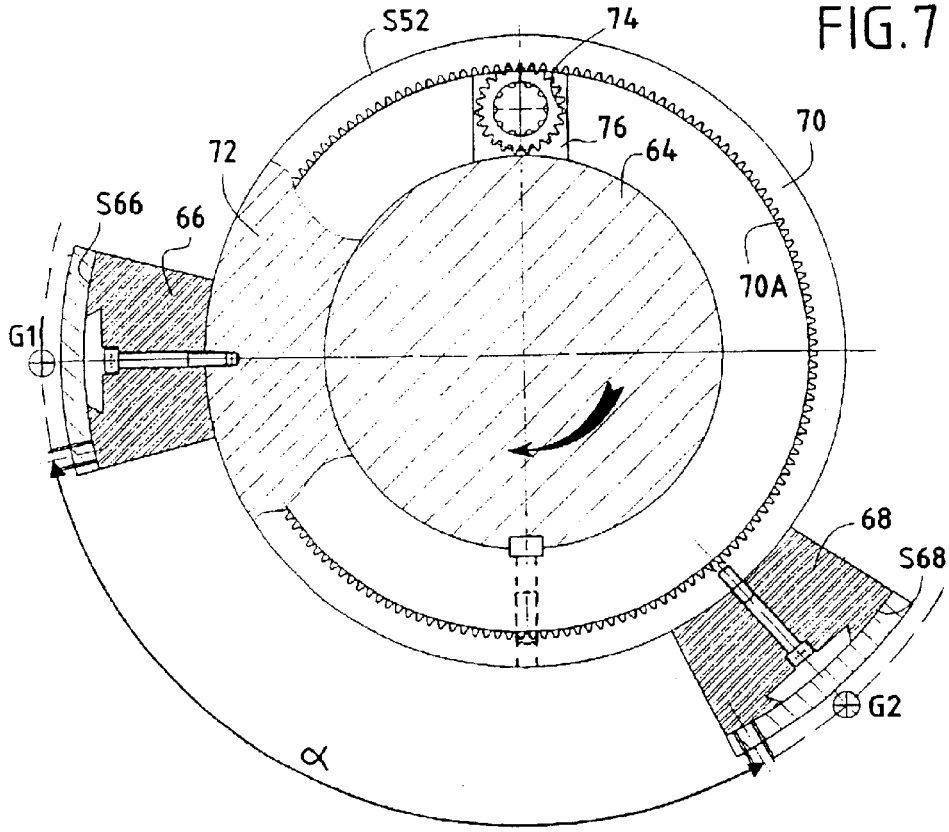
Figure 8:
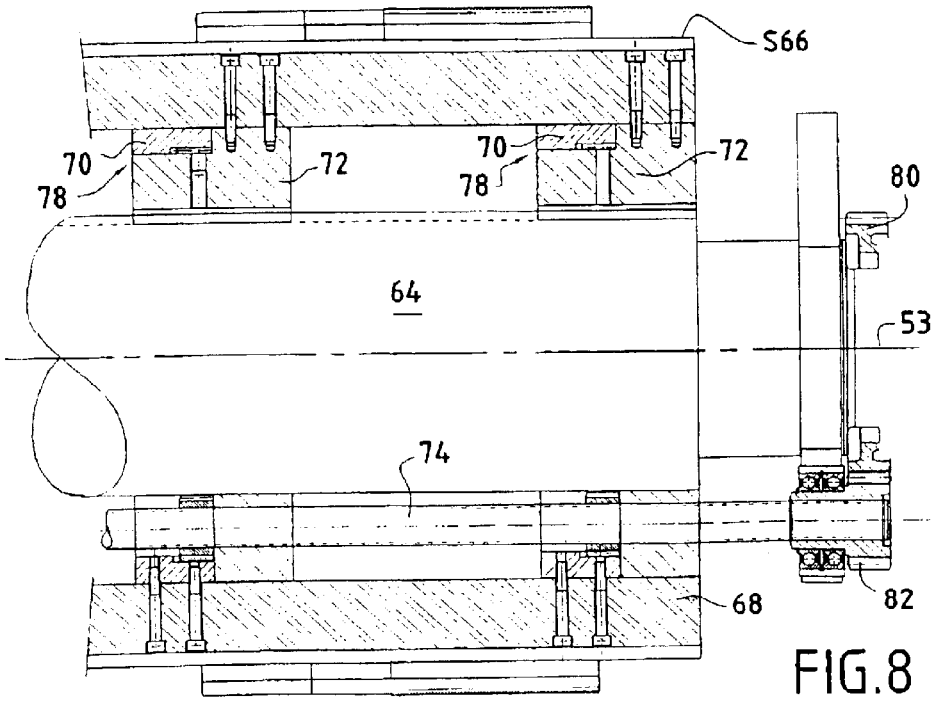
Figure 14:
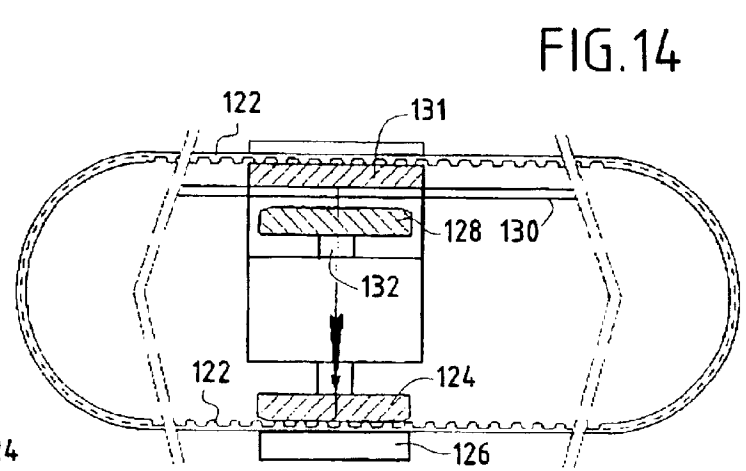
Figure 15:
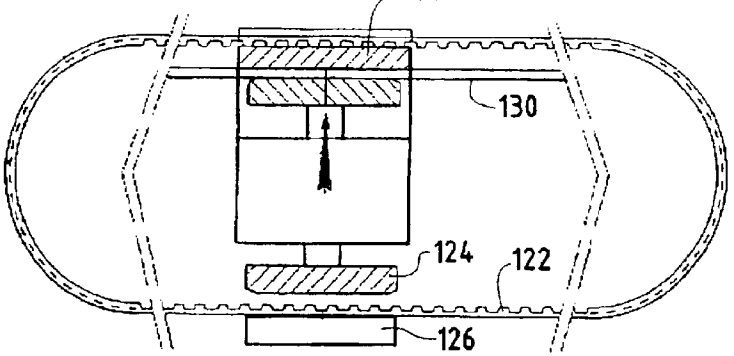
Figure 13:
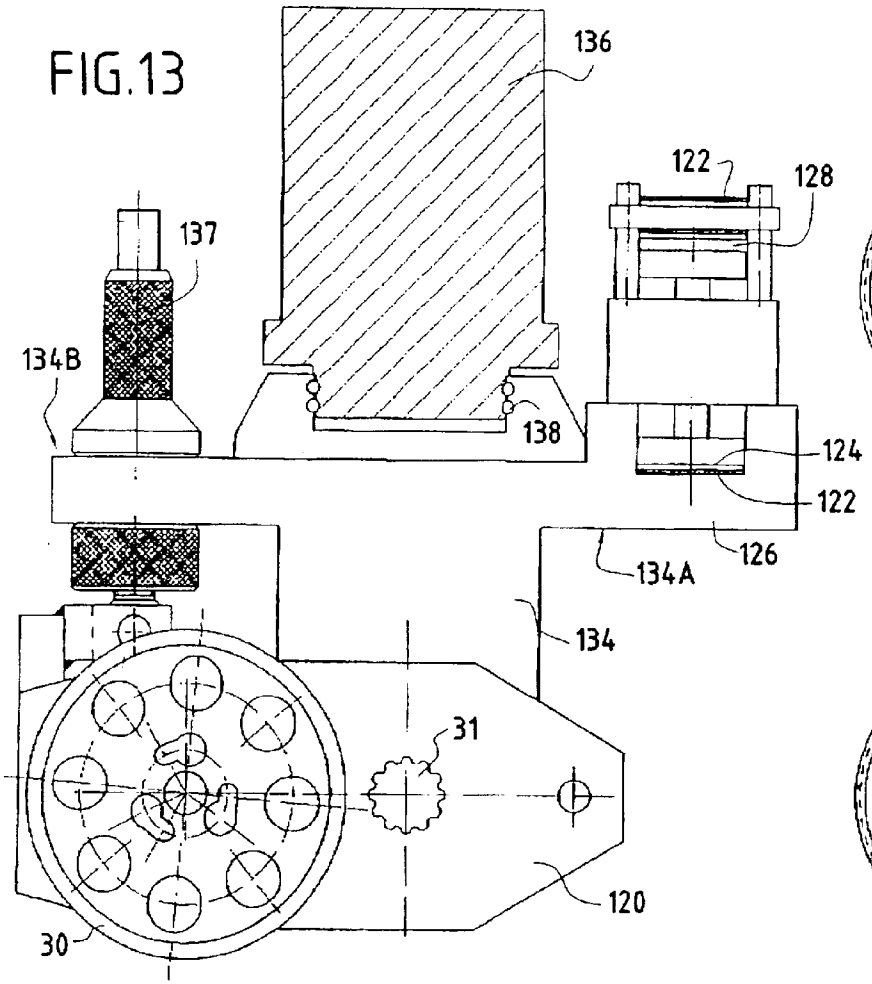

FIG. 3 diagrammatically shows the main members of the machine and the way its moving parts are linked;

FIG. 4 is a summary perspective view of the main members of the machine, with the principle of their control means;

FIGS. 5 and 6 are fragmentary vertical section views at the inlet of the machine;

FIG. 7 is a section view in a vertical plane parallel to the drive direction in which the sheets are driven through the machine, showing a carrier shaft with angular tool adjustment;

FIG. 8 is a view of the same shaft in section in a vertical plane perpendicular to the drive direction in which the sheets are driven through the machine, showing an end region of said shaft;

FIGS. 9, 10, and 11 show how a tool can be fitted rapidly to a tool holder on the shaft of FIGS. 7 and 8;

FIGS. 12A, 12B, 12C, and 12D are diagrams showing the principles of how a multi-tool carrier shaft moves;

FIG. 13 shows, in a vertical plane, how a drive wheel whose position is adjustable is fitted; and FIGS. 14 and 15 are diagrams in a vertical plane perpendicular to the drive direction in which the sheets are driven through the machine, showing how the position of said wheel is adjusted.

DETAILED DESCRIPTION OF THE INVENTION

Figure 1:
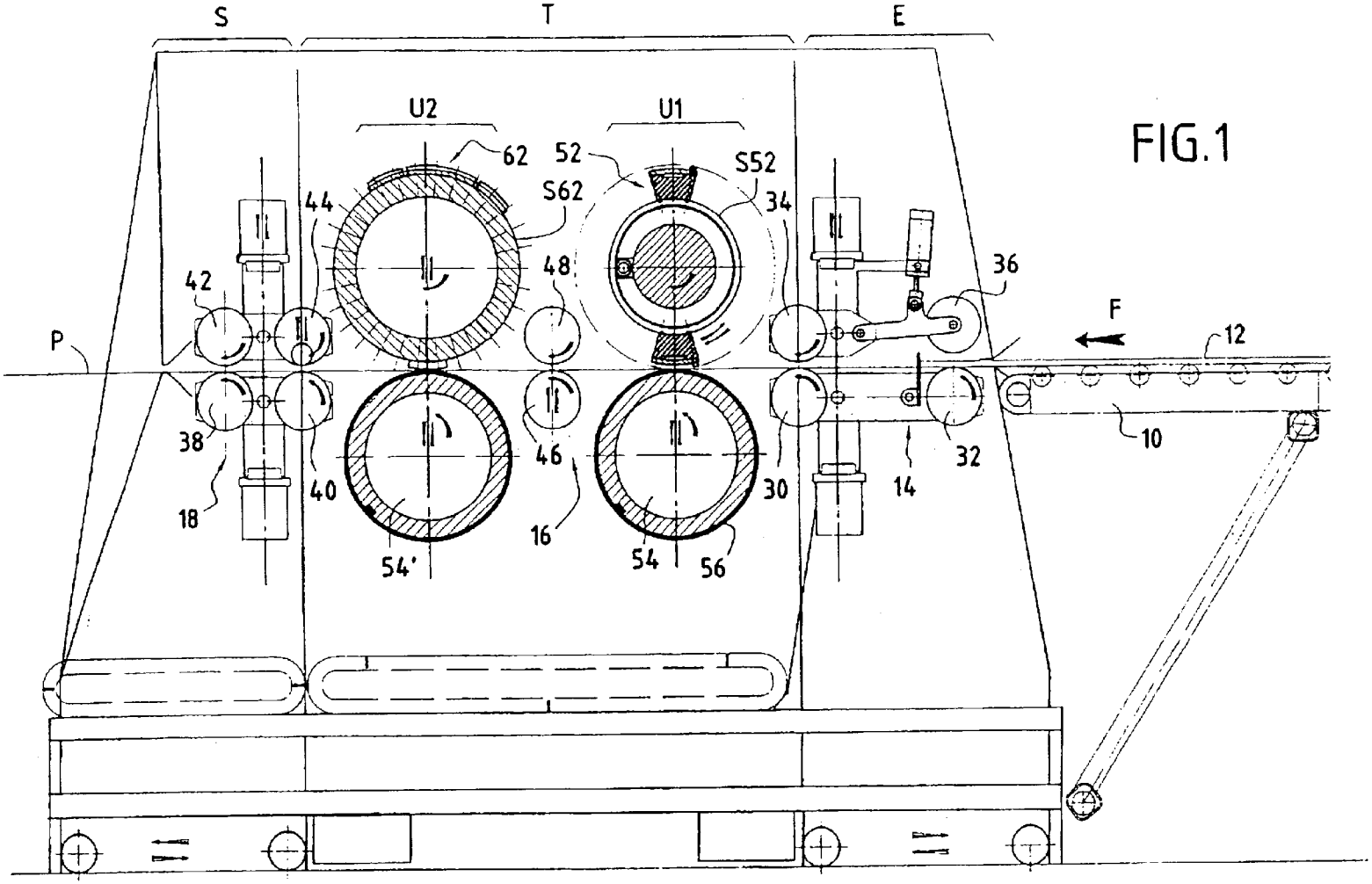
FIG. 1 is a view of the machine in section on a vertical plane.

The machine shown in FIG. 1 has a feed table 10 on which a sheet 12, e.g. a sheet of a material such as cardboard or plastic, is disposed for the purpose of treating it inside the machine.

The machine has an inlet zone E, a treatment zone T, and an outlet zone S disposed in succession in the advance direction F in which the sheets advance. In the inlet zone, the sheets are received by drive means 14 which drive them at constant speed through the treatment zone. In the example shown, the treatment zone T is made up of two treatment units, respectively U1 and U2, disposed in succession in the direction F. Between the two units lie drive relay means 16. Drive means 18 are also provided at the outlet S of the machine.

Figure 2:
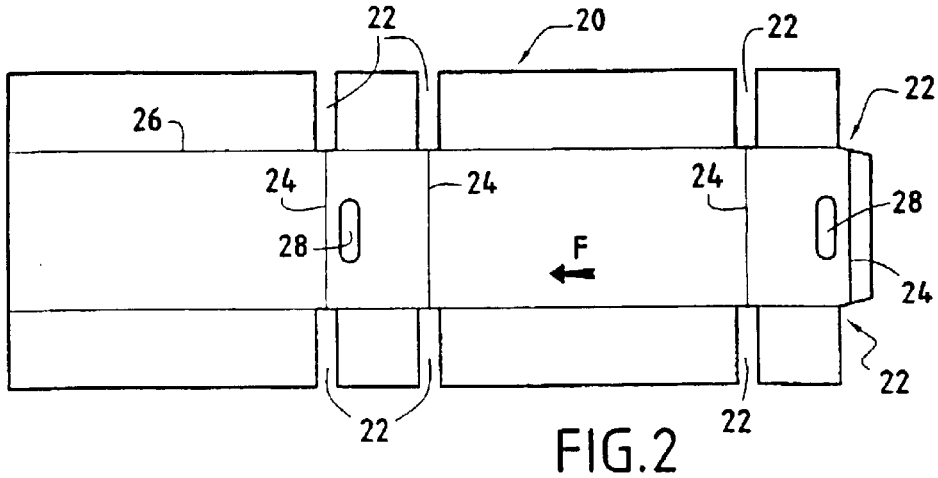
FIG. 2 shows a blank of an item of packaging after it has been treated by the machine.

The machine serves to treat sheets so as to shape them to enable them to be subsequently folded to form an item of packaging. For example, FIG. 2 shows a blank treated by the machine starting from an uninterrupted sheet. The blank 20 is provided with cutouts 22 and folds 24 that are disposed transversely relative to the advance direction F in which the sheet advances through the machine. The tools of the treatment units U1 and U2 situated in the treatment zone T of the machine make it possible to form said cutouts and said folds. Said tools comprise cutting tools or blades that form the cutouts 22 and scoring tools or scorers that form the folds 24.

The blank shown in FIG. 2 also has folds 26 which are disposed parallel to the drive direction F. As explained below, these folds can be formed by means of scoring wheels that co-operate with the drive means. The blank is also provided with specific cutouts, e.g. orifices 28 serving to form handles in the item of packaging, which are formed in one of the treatment units U1 or U2.

The drive means of the machine comprise drive wheels in the form of disks that are rotated. For example, FIG. 1 shows bottom drive wheels 30 and 32 and top drive wheels 34 and 36 at the inlet of the machine. Similarly, at the outlet, the drive means 18 are made up of bottom wheels 38 and 40 and top wheels 42 and 44. The drive relay means 16 also comprise bottom wheels 46 and top wheels 48. As shown in FIG. 1, each of the drive means 14 and 18 comprises two rows of wheels, a bottom row and a top row. For reasons of simplicity, only one row of wheels is shown in diagrammatic FIGS. 3 and 4.

Thus, at the inlet, FIG. 4 shows bottom wheels 30 and top wheels 34 respectively mounted on a bottom shaft 31 and on a top shaft 35. Similarly, at the outlet, the bottom and top wheels 38 and 42 are mounted on respective shafts 39 and 43, while the intermediate wheels 46 and 48 of the relay 16 are mounted on respective shafts 47 and 49. The drive means are driven by a main drive motor M50 such as a (type of motor to be specified). The various shafts are connected together by transmission means such as belts 51.

As explained below and as suggested by the variant in FIG. 3, instead of being mounted directly on their respective drive shafts, the drive wheels, e.g. those situated at the inlet and/or at the outlet, may be mounted on wheel supports which make it possible to adjust their respective positions.

The diagrammatic view of FIG. 3, which shows the moving parts of the machine, shows, side-by-side, elements that are in reality one above the other. Thus, the bottom and top shafts 31 and 35 are shown side-by-side, as are the shafts 47 and 49 and the shafts 39 and 43.

It should be noted that the inlet zone E, the treatment zone T, and the outlet zone S may be situated in separable modules, in which case the main motor M50 drives a shaft A50 directly, which shaft may, for example, be situated in the treatment zone, and is itself coupled by means of the Oldham coupling type to driven shafts A50E for the inlet and A50S for the outlet.

Each of the treatment units U1 and U2 has a carrier shaft which carries treatment tooling. Firstly, unit U1 is described, with its carrier shaft 52, referred to below as a "carrier shaft with angular tool adjustment".

This shaft is situated above the advance plane P in which the sheets advance through the machine, and it co-operates via the tools that it carries with a backing shaft 54 situated under said plane. The backing shaft carries a covering 56, e.g. made of a material such as polyurethane, sufficiently flexible to enable the tools to perform their functions, e.g. folding or cutting the sheet. Similarly, a backing shaft 54' is situated under the carrier shaft 62 of the treatment unit U2.

The backing shafts and the bottom drive wheels can be displaced vertically to adapt to accommodate sheets of various thicknesses.

The backing shafts may be driven in rotation in the same way as the drive means, e.g. by means of the main motor M50. However, they are advantageously driven by an accessory motor M54, e.g. an asynchronous motor with a frequency variator, controlled to drive the sheets at the same speed as the drive means, i.e. the tangential velocity of the backing shafts is the same as the tangential velocity of the drive wheels, in spite of their different diameters.

The transverse carrier shaft 52 is driven in rotation by a shaft motor M52 which is distinct from the motor(s) of the drive means and of the backing shafts. For example, it may be an asynchronous motor, a brush-less motor, or in general, a positioning motor. The shaft 52 is coupled to the outlet of the motor via a drive pin 53.

As shown in FIG. 4, the machine includes a control unit UC which, as a function of information relating to the position of a sheet 12 in the treatment zone T, controls the shaft motor M52 via a control line L52 in a manner such that, in order for the sheet to be treated by tooling carried by the shaft 52, said tooling is in contact with a predetermined region of the sheet, and it moves at the same tangential velocity as the drive speed at which the sheet is driven.

The control unit knows the speed of the drive means 14, 16, and 18. For example, via a control line L50, it controls the main drive motor M50. In addition, it receives information from a speed sensor C50, e.g. a tachometer constrained to rotate with one of the shafts of the drive means, via an information input line LE50. Said control unit can thus adjust its control of the motor M50.

It also knows the position of a sheet in the machine. For this purpose, it receives information delivered by position sensors such as photoelectric cells C1, C2, C3 disposed in succession on the path along which the sheets advance, and which are connected to it by information input lines, respectively LC1, LC2, and LC3.

For example, as can be seen in FIGS. 5 and 6, the sheet 12 is detected at the inlet by the sensor C1 and it is optionally retained by a moving abutment 60. At the chosen time, the sheet starts to be driven, i.e. the abutment 60 is retracted and the sheet is nipped between the bottom and top drive means such as the wheels 32 and 36. The sensor C2 is disposed downstream from the sensor C1, e.g. immediately downstream from the drive wheels 30 and 34, and it detects the arrival of the sheet. This makes it possible, whenever necessary, to correct the speed of the motor M50 or to correct the data serving to control the motor M52 if, due to any slippage, the speed at which the sheet moves between the sensors C1 and C2 is not strictly equal to the speed of the drive means.

Thus, the control unit knows precisely the advance speed and the position of the sheet in the machine. Therefore, as a function of parameterizing means MP input into the control unit to store which treatment (cutting-out, folding) is to be applied to which region of the sheet, the control unit can control the motor M52 independently of the drive means so that it positions its tools in the right places, at the right times, and at the right speeds.

The tool-carrying shaft 62 is referred to as a "multiple-tool carrier shaft". This shaft 62 is disposed above the plane P in the treatment zone, and it co-operates with the backing shaft 54' analogous to the shaft 54. The shaft 62 is rotated by a motor M62, e.g. a motor analogous to the motor M52 of the shaft 52 and which, like that motor, is distinct from the motor(s) of the drive means and of the backing shafts. Like the motor M52, the motor M62 is controlled by the control unit UC, via a control line L62 so as to set the speed and the position of the shaft 62 so that the tools that it carries co-operate with the sheets at the right places, at the right times, and at the right speeds.

Via the lines LE52 and LE62 connected to the sensors, the control unit knows the speeds of the tool-carrying shafts 52 and 62 and can, as a function of that data, modify its control of the motors M52 and M62. Via a line LE54, also connected to sensors, it also knows the speeds of the backing shafts 54 and 54', and it can correct the control of the motor M54 accordingly.

The sheets are driven through the machine at a substantially constant drive speed. Since the control unit UC knows said speed and the position of the sheet, it causes the motor M52 or the motor M62 to go from a waiting stage, during which its speed is zero or substantially zero, to a positioning stage during which its speed is different from the drive speed (it is higher in general) so as to position the appropriate tool correctly relative to the position that is going to be reached by the region of the sheet that is to be treated by the tool. The positioning stage is followed by a treatment stage into which the motor M52 or M62 is caused to go when said region of the sheet is situated facing the shaft 52 or 62. During this treatment stage, the tangential velocity of said tool is equal to the advance speed so as to perform the desired treatment. A new waiting stage follows the treatment stage.

This cycle is reproduced one or more times per sheet, as a function of the treatment(s) (cutting-out, folding, etc.) to be applied.

Between the waiting stage and the positioning or treatment stage, the motor 52 or 62 undergoes a very fast acceleration or deceleration stage.

The parameterizing means correspond to a type of treatment chosen from various possible types of treatment, each corresponding to a type of packaging to be manufactured (dimensions of sheets, shape of the packaging after folding and fastening the sheets, corresponding positioning of the folds and of the cutouts).

The carrier shaft with angular tool adjustment 52 carries two tools spaced apart angularly. As can be seen more clearly in FIG. 7, it has a shaft hub 64 which is coupled to the drive pin 53. It also has a fixed tool holder 66 which is secured to the hub 64, and a moving tool holder 68 which is secured to a moving support 70 constituted, in this example, by one or more moving bands. FIG. 7 shows the tools held by the two tool holders 66 and 68 spaced apart angularly at an angle $\alpha$, but, in FIGS. 1 and 8, to make the drawings more convenient, the two tool holders are diametrically opposite each other.

The fixed tool holder 66 is disposed along a first cylinder generator line G1 by being fixed to the hub, e.g. via fixing and spacing shoes 72. The moving tool holder is fixed to the band 70 while being disposed on a second cylinder generator line G2. The tool holders 66 and 68 are disposed such that their surfaces that carry respective tools S66 and S68 are situated on the same cylindrical surface.

Because of the thickness of each of the tool holders, these surfaces S66 and S68 project relative to the cylindrical surface S52 of the remainder of the shaft 52, in particular determined by the band 70. As a result, when a portion of the shaft 52 that is situated between the tool holders 66 and 68 is situated facing the sheet undergoing treatment, said portion is not in contact with said sheet, so that it is not necessary to move the shaft 52 away from the path along which the sheet advances.

The band 70 is provided with an inner set of teeth 70A which meshes with a cog shaft 74 disposed between the hub 64 and the band. Optionally, said cog shaft is carried by a bearing 76 suitable for sliding on the surface of the hub 64. As shown in FIG. 8, a space 8 is provided between the outside surface S66 of the fixed tool holder and the hub 64 to enable the circular band 70 to pass through. In this example, this annular space is provided in the outside face of the shoe 72. As also shown in FIG. 8, a plurality of bands 70 of analogous shape and a plurality of shoes 72 may be disposed along the hub 64.

It can be understood that, when the cog shaft 74 is turned, it moves the band 70, i.e. it also moves the moving tool holder. The dimensions of the shoe 72 determine the minimum space that it is possible to obtain between the fixed tool holder and the moving tool holder.

It is possible to drive the cog shaft in rotation by means of a manual device such as a crank handle that is put in place only when it is necessary to move the moving tool holder.

In this example, the means for driving the cog shaft 74 in rotation comprise a toothed wheel 80 coaxial with the drive pin 53 of the shaft 52 and mounted to rotate freely about said pin (FIGS. 3 and 8). Said toothed wheel meshes on the cog shaft 74 and co-operates with rotary drive means. In FIG. 8, it can be seen that the end of the shaft 74 carries a toothed drive wheel 82 that co-operates with the wheel 80.

Thus, to move the moving tool holder, it is necessary merely to rotate the toothed wheel 80. It can be seen in FIG. 3 that it is coupled to an accessory motor M80 via a differential D80. For simplification reasons, the motor M80 is not shown in the summary diagram of FIG. 4. It can however be understood that it can be controlled by the control unit by means of a control line L80.

The carrier shaft 52 or 62 is advantageously provided with a tool holder that is equipped with fast fixing means for fixing a tool. In this example, this applies to shaft 52, and the shape of these means can be better understood from FIGS. 7 and 9 to 10.

In FIGS. 9 and 10, only one of the tool holders 66 and 68, e.g. the tool holder 66, is shown in section perpendicular to the axis of the carrier shaft. It can be seen that its carrier surface S66 is provided with a longitudinal fixing groove 84 whose longitudinal edge 84A is a moving edge. It is defined by a moving wedging piece 86 which is in the form of a longitudinal rod. The rod is mounted to move between a locking position (FIG. 10, in which the edge 84A co-operates with the opposite edge 84A of the groove 84 to form a retaining profile, and an unlocking position (FIG. 9) in which the edge 84A is spaced apart from the edge 84B to enable a tool to be put in place easily in the groove. In this example, the edge 84A is defined by a setback provided in the rod 86, and said rod is mounted to turn about its longitudinal axis between its locking position and its releasing position.

For example, the retaining profile of the groove 84 may be a dovetail profile or a T-profile. The back of the tool 88 is provided with a fixing rib 90 having a complementary retaining profile, and which can thus fit into the groove. For example, the tool proper (e.g. formed by two blades 94) is carried by a plate or a base 92 whose curvature defines a cylindrical surface so that, while the carrier shaft is being turned to treat a sheet in the machine, the distance between the tool and the plane P remains constant.

The machine is provided with cutting tools such as the tool 88 shown in FIGS. 9 to 11, each of which cutting tools has a cutting portion (blades 94), and with scoring tools such as the tool 88' of FIG. 11, each of which scoring tools has a scoring portion (rib 96). Each of the tools further has a base 92 carrying the fixing rib 90. Once the ribs 90 are inserted in the groove 84, the tools can be moved in translation to be disposed one against another. Thus, the tools 88 and 8' can be disposed against the tool 88" of FIG. 11.

By using these very simple fixing means, it is very easy to dispose the tools in a chosen order, side-by-side on the tool holder, and, at chosen spacing, so as to adapt them to manufacturing various different types of packaging.

Each of the shafts 52 and 62 can carry a plurality of tools, and can thus be driven in a cycle comprising a treatment stage in which treatment is performed by a first tool, a positioning stage, and a treatment stage in which treatment is performed by a second tool. For the shaft 52, for which the spacing between the tools is adjustable, and for which the tools project relative to its cylindrical surface so that it is not necessary to move them away from the path along which the sheets advance, the positioning stage may consist merely in continuing to drive it at the same speed between two treatment stages.

The shaft 62 also carries a plurality of tools spaced apart angularly, but, in the working position, its cylindrical surface S62 is in the vicinity of the advance plane P in which the sheets advance. For example, the tools may be mounted merely on plates which are screwed into radial tapped holes provided in the cylindrical surface of the shaft 62. FIG. 4 shows that, for example, the shaft 62 carries a tool 100 having a blade serving to form orifices such as the openings 28 in the blank shown in FIG. 2.

FIGS. 12A to 12D diagrammatically show said shaft 62 in cross-section, and it carries four tools numbered from 100 to 103, which are spaced apart angularly. A sheet 12 disposed on the plane P in which the sheets advance is indicated in these figures. After a first determined region of the sheet R1 has been treated by the first tool 100, and before a second determined region of the sheet R2 is treated by another tool, e.g. tool 103, the shaft 62 is driven in its positioning stage. Insofar as its cylindrical surface S62 is too close to the sheet in the working position, said shaft 62 is moved away from the path in which the sheets advance through the treatment zone during the positioning phase.

The control means causing said shaft to move away from the advance path are shown in FIGS. 4 and 12A to 12D. They comprise a moving-away shaft 106 which carries at least one eccentric cam 108. The carrier shaft 62 is mounted on a moving axle 110 which is supported by the moving-away shaft 106 via the eccentric cam.

In this example, the shaft 106 is fixed relative to the frame of the machine, and the eccentric cam 108 is formed by a wheel which is connected to it in an eccentric position. The wheel 108 is driven in rotation by a moving-away motor M108 about its axis. Thus, while it is turning, the wheel 108 moves about the center of the shaft 106 by going through the various positions shown in FIGS. 12A to 12D.

The axle 110 of the shaft 62 is supported by the moving-away shaft 106 via the wheel 108. More precisely, the wheel is connected to the shaft 62 via a system of links 112. In this example, the shaft 106 extends transversely inside the treatment zone and, at each of its ends, it carries a wheel 108 mounted to turn at the first end of a link 112 whose second end is connected to the shaft 62 while being hinged relative thereto. In this example, this connection is indirect, and uses a lever 114, as indicated below.

Advantageously, the moving axle 110 is secured to a lever which carries a counterweight serving to make it easier for the carrier shaft to move upwards.

In FIG. 4, it can be seen that each link 112 is hinged via its second end to a lever 114 having an end portion carrying the axle 110 of the shaft 62 directly, and whose opposite end carries a counterweight 116. The levers 114 are shown to pivot about a pivot axis A114. The counterweight 116 is balanced relative to the shaft 62 so that the force necessary to raise said shaft 62 is low.

Figure 12A:
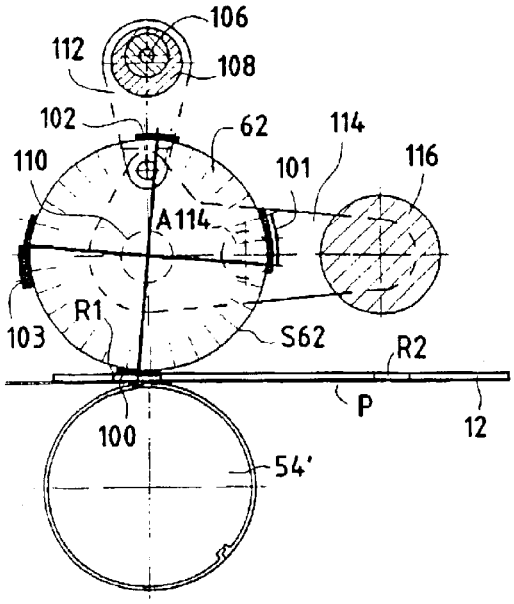
Figure 12B:
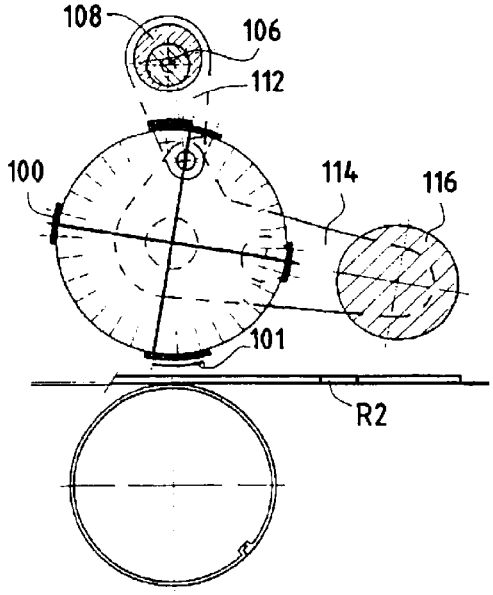
Figure 12C:
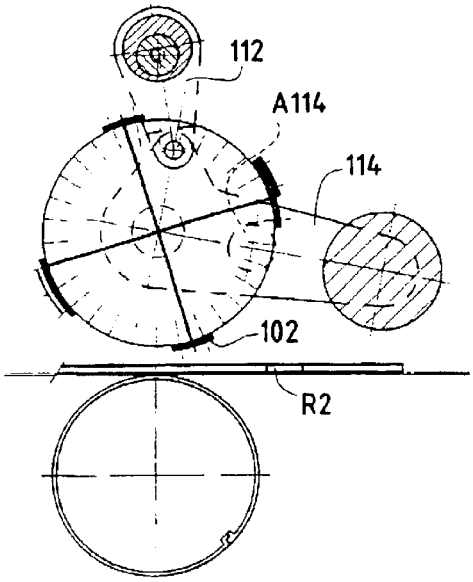
Figure 12D:
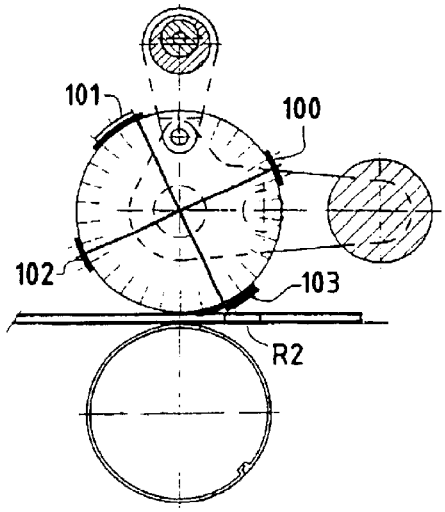

In FIG. 12A, the shaft 62 is lowered so that the tool 100 comes into contact with the sheet 12. During the treatment stage, it turns at a speed such that the tool moves at exactly the same speed as the sheet. As soon as the treatment of the region R1 is finished, the motor M108 is caused to operate by the control unit UC, to which it is connected via a control line L108, so as to raise the carrier shaft 62. During this positioning stage, the motor M62 is caused to operate by the control unit so as to bring the tool that is to perform the following treatment, e.g. tool 103, into the situation in which it can perform said treatment. Via a line LE108 connected to a sensor, the control unit is informed of the speed of the motor M108 so as to adjust it accordingly.

The drive means have drive wheels such as those of the relay 16, it not being necessary to modify their spacing in the transverse direction of the machine. Similarly, the stations 14 and 18 may have wheels that are fixed in translation. However, in certain cases, it can be necessary to modify the positions of the wheels. Indeed, it is also possible to add certain wheels that, in addition to being drive wheels, also perform certain operations such as forming cutouts or folds disposed longitudinally in the advance direction in which the sheet advances.

FIG. 3 shows the bottom wheels 20 and the top wheels 34 of the inlet station 14, and the bottom wheels 40 and the top wheels 44 of the outlet station 18, in the form of adjustable-position wheels.

By way of example, FIG. 13 shows a wheel 30. Like the other adjustable wheels, it is mounted on a wheel support 120 which can be moved transversely relative to the drive direction F. For this purpose, the machine includes an adjustment belt 122 which is driven transversely to the direction F. This belt is driven by means such as a motor M122 (FIG. 3).

The wheel supports 120 can be coupled to the belt to enable the wheels to be moved, or else decoupled relative to the belt and locked to hold the wheels in position.

Thus, each wheel support 120 has a coupling shoe 124 and a coupling backing shoe 126 which are disposed on either side of the belt 122 (on one of the runs of the loop that it forms). The shoe 124 can be placed in a coupling position (FIG. 14), in which it presses the belt 122 against the backing shoe 126, so that the wheel support 120 and the wheel that it carries are moved with the belt. The shoe can also take up an inactive position (FIG. 15), in which it is spaced apart from the belt.

Each wheel support 120 also has a stop shoe 128 which can be placed in a stop position (FIG. 15), in which it co-operates with a fixed locking part 130 to secure the wheel 120 to said part and to lock it in the desired position, and which can be placed in an inactive position (FIG. 14), in which it is spaced apart from said locking part 130.

The machine has control means for controlling the coupling shoe 124 and the stop shoe 128, which means are suitable for placing the coupling shoe in its coupling position when the stop shoe is in its inactive position, and suitable for placing the stop shoe in its stop position when the coupling shoe is in its inactive position.

Quite simply, the stop shoe 128 and the coupling shoe 124 may be disposed at respective ones of the two ends of a rod 132 mounted to move back and forth. For example, the rod is caused to go between its two positions by a pneumatic actuator.

The fixed locking part may be constituted by a fixed belt that is tensioned parallel to that run of the belt 122 with which the shoe 124 co-operates, or by some other part such as a fixed plate or the like. If necessary, it may be disposed between the shoe 130 and a backing shoe 131 so as to be clamped between them in the stop position.

As can be seen in FIG. 13, the wheel support 120 is secured to the fluted drive pin 31. It has a toothed wheel whose inner periphery meshes with said pin and which, itself, drives a system of toothed wheels for transmitting the drive to the wheel 30. The mode of mechanical coupling with the fluted pin 31 makes it possible for the support 120 to be moved in translation along said pin. The support 120 is carried by a bracket 134 which is itself supported by a support beam 136 disposed transversely to the direction F. The bracket 134 slides via ball slideways 138 along the top end of said beam. The shoes 124 and 128 and the backing shoes 126 and 131 are carried by an arm 134A of the bracket 134. The belt 122 is disposed vertically, the shoe 128 co-operating with one of its horizontal runs (the bottom run). Another arm 134B of the bracket 134 supports an actuator 137 which serves to adjust the vertical position of the wheel 30 relative to its support 120, so as to adapt said position to different sheet thicknesses.

What is claimed is:

1. A machine for treating sheets, for manufacturing packaging made from sheets of materials including cardboard or plastic, said machine comprising drive means having at least one drive motor and suitable for driving sheets in a drive direction through a treatment zone situated between an inlet and an outlet of the machine, treatment tooling designed to form cutouts and/or folds that are disposed transversely relative to the drive direction in said sheets, means for determining information relating to the position of a sheet in the treatment zone, and control means for controlling the treatment tooling as a function of said information, the treatment tooling being carried by at least one transverse carrier shaft rotated by a shaft motor, the drive means being driven by a main drive motor and being adapted to drive the sheets at a substantially constant drive speed between the inlet and the outlet of the machine and in said treatment zone, the shaft motor being distinct from said main motor, and the machine further comprising a control unit adapted to act as a function of said drive speed and of the information relating to the position of the sheet in the treatment zone, to control the shaft motor, in cycles comprising a waiting stage, a positioning stage in which said motor angularly positions the tooling of the transverse carrier shaft, and a treatment stage, in which for treating said sheet, the tooling is in contact with a predetermined region of the sheet and is driven at a treatment speed whose tangential component is equal to said drive speed, the carrier shaft having a cylindrical surface which is not in contact with the sheet during said waiting stage and said positioning stage.

2. A machine as claimed in claim 1, wherein the control unit is suitable for controlling the shaft motor as a function of parameterizing means corresponding to a selected type of treatment.

3. A machine as claimed in claim 1, having a carrier shaft with angular tool adjustment comprising a hub, a fixed tool holder secured to the hub, and a moving tool holder secured to a moving support which co-operates with the hub via position adjustment means for adjusting the angular position of the moving tool holder relative to the fixed tool holder.

4. A machine as claimed in claim 3, wherein the fixed tool holder is fixed to the hub by being disposed on a first cylinder generator line, the moving support comprising at least one band to which the moving tool holder is fixed along a second cylinder generator line, said band being coaxial with the hub, having an inner set of teeth and extending, in the region of the first generator line in a space provided between the outside surface of the fixed tool holder and the hub, and wherein the position adjustment means comprise a cog shaft which is disposed between the hub and the band while co-operating with the inner set of teeth of said band, and means for driving the cog shaft in rotation, so as to cause the band to turn relative to the hub and thus to adjust an angular positioning of the second generator line relative to the first generator line.

5. A machine as claimed in claim 4, wherein the means for driving the cog shaft in rotation comprise a toothed wheel coaxial with the drive pin of the carrier shaft with angular tool adjustment and mounted to rotate freely about said pin, said toothed wheel meshing on the cog shaft and co-operating with the rotary drive means.

6. A machine as claimed in claim 4, having cutting tools and scoring tools, each of which has a cutting portion or a scoring portion, and a base carrying a fixing rib adapted to co-operate with the fixing groove in a tool holder, for disposing said tools in any chosen order side-by-side on the tool holder.

7. A machine as claimed in claim 1, wherein the transverse carrier shaft has at least one tool holder equipped with fast fixing means for a tool, said means comprise a longitudinal fixing groove situated on the outside surface of the tool holder, said groove having two opposite longitudinal edges at least one of said longitudinal edges being a moving edge and being defined by a wedging piece that is mounted to move between a locking position, in which a retaining profile adapted to retain a fixing rib having a complementary profile is defined between said wedging piece and the opposite longitudinal edge, and an unlocking position, in which said at least one edge is spaced apart from the opposite edge to enable the fixing rib to be inserted into said groove, by moving the rib radially towards the axis of the carrier shaft.

8. A machine as claimed in claim 7, wherein the wedging piece is formed by a longitudinal rod whose cross-section has a setback defining the moving longitudinal edge, said rod being suitable for turning about its longitudinal axis between its unlocking and locking positions.

9. A machine as claimed in claim 1, having a multiple tool carrier shaft for carrying at least first and second tools spaced angularly apart, the control unit being adapted for controlling the shaft motor of said multiple tool carrier shaft in compliance with a cycle comprising a first tool treatment stage during which the first tool is in contact with a first determined region of a sheet situated in the treatment zone of the machine and is driven at a tangential velocity equal to drive speed at which said sheet is driven, a positioning phase during which the multiple tool carrier shaft is driven to position the second tool in a situation in which said second tool is located for treating a second determined region of the sheet, and a second tool treatment stage, during which the second tool is in contact with said second region and is driven at a tangential velocity equal to the drive speed.

10. A machine as claimed in claim 9, having means for moving the multiple tool carrier shaft away from the advance path along which the sheets advance through the treatment zone during the positioning stage.

11. A machine as claimed in claim 10, having a moving-away shaft carrying at least one eccentric cam, the transverse carrier shaft being mounted on a moving axle supported by the moving-away shaft via said eccentric cam.

12. A machine as claimed in claim 11, wherein the moving axle is secured to a lever which carries a counterweight for facilitating an upward movement of the carrier shaft.

13. A machine as claimed in claim 1, wherein the drive means co-operate with adjustable-position drive wheels which are mounted on wheel supports, the machine having means for adjusting the positions of said supports transversely relative to the drive direction in which the sheets are driven through the machine.

14. A machine as claimed in claim 13, having at least one adjustment belt disposed transversely relative to the drive direction in which the sheets are driven, means for driving said belt, and coupling means adapted to be caused to go between a coupling situation in which they secure a wheel support to said belt, and a stop position in which they secure said wheel support to a fixed locking part.

15. A machine as claimed in claim 14, wherein each of the supports for the adjustable-position drive wheels comprises a coupling shoe and a coupling backing shoe disposed on either side of the belt, said coupling shoe being mounted to move between a coupling position in which said coupling shoe presses the belt against said coupling backing shoe and an inactive position in which said coupling shoe is spaced apart from the belt.

16. A machine as claimed in claim 15, wherein each of the supports for the adjustable-position drive wheels further comprises a stop shoe mounted to move between a stop position in which said stop shoe co-operates with the fixed locking part to secure the support to said fixed locking part, and an inactive position in which said stop shoe is spaced apart from said locking part, the machine having means for controlling the coupling shoe and the stop shoe, which means are adapted to place the coupling shoe in the coupling position thereof when the stop shoe is in the inactive position thereof, and to place the stop shoe in the stop position thereof when the coupling shoe is in the inactive position thereof.

17. A machine as claimed in claim 16, wherein the stop shoe and the coupling shoe are disposed at respective ends of a rod that is mounted to move back and forth.

* * * * *